United States Patent [19]

Addison

[11] Patent Number: 5,013,103

[45] Date of Patent: May 7, 1991

[54] QUALITY CONTROL WORK STATION

[75] Inventor: Thomas E. Addison, Racine, Wis.

[73] Assignee: Qualtech of Racine, Inc., Racine, Wis.

[21] Appl. No.: 390,201

[22] Filed: Aug. 7, 1989

[51] Int. Cl.[5] ..... A47B 91/00

[52] U.S. Cl. ..... 312/250; 312/234; 248/316.3

[58] Field of Search ..... 312/250, 208, 234, 230, 312/233; 248/316.3, 918, 442.2, 129; 211/44, 45

[56] References Cited

U.S. PATENT DOCUMENTS

| | | | |
|---|---|---|---|
| 1,685,041 | 9/1928 | Binkele | 248/442.2 |
| 1,879,284 | 9/1932 | Johnson et al. | 248/442.2 |
| 2,151,259 | 3/1939 | Young | 312/233 |
| 2,778,704 | 1/1957 | Joachim . | |
| 3,168,954 | 2/1965 | Van Herrmann | 248/316.3 X |
| 3,240,458 | 3/1966 | Schaeffer | 248/129 |
| 3,715,148 | 2/1973 | Beals . | |
| 4,428,631 | 1/1984 | Cope et al. | 312/233 X |
| 4,562,482 | 12/1985 | Brown | 312/208 X |
| 4,640,199 | 2/1987 | Zigman . | |
| 4,693,443 | 9/1987 | Drain | 248/316.3 X |
| 4,735,469 | 4/1988 | Liggett | 312/233 |
| 4,820,003 | 4/1989 | Lloyd | 312/250 X |

*Primary Examiner*—Joseph Falk

*Attorney, Agent, or Firm*—Peter N. Jansson, Ltd.

[57] ABSTRACT

An improved quality control work station includes a support frame with a pair of side members, each of the side members having an upwardly extending rear support member, a work panel with a horizontal first surface terminating in a rear edge and a forward second surface angled downwardly from the first surface, and a display panel attached to the rear support members at a position above the rear edge of the first surface. The display panel includes a generally planar display surface which may be positioned to be normal to the line of vision of a user of the station, and has means for retaining a data collecting device. A plurality of wheels is disposed in a load supporting relationship to the frame for permitting easy relocation of the work station.

15 Claims, 2 Drawing Sheets

QUALITY CONTROL WORK STATION

FIELD OF THE INVENTION

This invention is related generally to work stations and, more particularly, to work stations for performing inspection and other quality control functions.

BACKGROUND OF THE INVENTION

Cabinets, tables, mounting stands and other work stations are commonly employed in factory, shop and office environments for supporting and displaying equipment used to perform particular functions. Many of these work stations are constructed to serve a single function. In a number of instances work stations combine two functions, namely, display of certain information and retention of special tools.

Some examples of multi-function work stations and the like are the devices disclosed in U.S. Pat. No(s). 4,640,199, 2,778,704 and 3,715,148. Each of these combines at least two functions, including information display and tool retention. However, each of these has problems and drawbacks for use in certain quality control functions which are required at numerous sites in a manufacturing plant.

The work stations described in these patents share at least two common characteristics. First, they are designed and arranged such that their information display is in only a single medium, e.g., video, printed cards or small legends. Second, each of these stations is designed and arranged to function with only limited types of operating tools and devices.

Stated another way, the design approach used to configure these work stations fails to recognize certain critical demands which the modern quality control function places upon work stations. Modern quality control work stations should be highly flexible in their utility and must permit the use of a variety of different devices and information media.

For example, one such demand arises from the fact that, on a factory floor, there may be many machining or other processing stations, some or all of which are numerically controlled by computers. In more sophisticated systems, these computers are electronically linked to one another by a local area network (LAN). If a problem is detected at so point in the process, it may be resolvable only by the use of statistical process control to develop corrective steps to be taken at one or more, perhaps several, other (usually preceding) points in the process.

Therefore, today's ideal work station for quality control purposes must accommodate certain electronic data collecting devices and have them readily available for the user. Of greatest value to the quality control person are those devices which will permit retrieval, storage, display and modification of computerized data appearing on the LAN.

Another demand arising from the quality control function relates to the fact that today's quality control person, working in a complex environment, must be able to perform inspections in a variety of ways. For example, one inspection mode would be to view data circulating or available on the LAN and representing one or more physical features of a part being manufactured. This data may be electronically collected and displayed. It may then be compared to the optimum or desired data which will often be reflected on printed documents. This need to perform inspection by comparing data embodied in two different media is another of the unusual demands of today's quality control function. A preferred quality control work station must accommodate this demand by making it easy to perform these comparisons in different media.

Yet another significant demand presented by today's quality control function relates to the fact that the work station user must not only be able to detect flaws in the manufacturing process by data comparison as described, but also must be able to create data for later use by himself or others. For example, parts which have passed through several machining steps may be required to be inspected by the work station user. These inspections may be performed using common, visually-read hand tools such as micrometers and gauges or by using more sophisticated tools which are electronically coupled to the LAN.

In the former case, the quality control work station user must be able to quickly record the data, either on paper or by entry into a database embodied in an electronic device. In the latter case, the data may immediately become available on the LAN. However, in both cases, the work station must accommodate storage and display of and quick access to all of the needed tools—electronic devices and the micrometers and gauges linked to them as well as data log paper and blueprints, for example. An ideal work station would be constructed to meet certain diverse yet basic needs and yet be adaptable to meet newly arising quality control requirements.

Still another demand arising from today's quality control environment is the need to quickly relocate a work station from place to place. One quality control inspector can supervise a relatively large manufacturing operation if his quality control work station is equipped to accommodate a number of varying functions and needs, and is quickly relocatable.

The work stations and mounting stands disclosed in the prior art, including the patents mentioned above, have failed to meet all of the requirements of the quality control profession. They may be responsive to some of the requirements, but may be incapable, e.g., of permitting display of or access to data in several different media and of being expanded to meet changing needs.

A quality control work station which lends itself to display of and access to media in several different forms, which integrates a variety of working tools used in performing quality control statistical process control, which permits easy coupling of certain of these tools to a LAN, and which can have additional storage and display capabilities to meet emerging quality control requirements would be an important advance in the art.

OBJECTS OF THE INVENTION

It is an object of this invention to overcome some of the problems and shortcomings of the prior art.

Another object of this invention is to provide a quality control work station which integrates a plurality of sophisticated tools used to perform the quality control function.

Another object of this invention is to provide a work station which is readily adaptable to meet changing quality control needs.

Still another object of the invention is to provide a quality control work station which lends itself to several different types of display involving paper and computerized media.

Yet another object of the invention is to provide a quality control work station which may be readily relocated within the factory or shop environment.

Still another object of this invention is to provide a quality control work station which includes a work surface having two planes, one substantially horizontal for the support of equipment and a second which is angularly disposed for more convenient writing thereon.

These and other important objects will be apparent from the descriptions of this invention which follow.

SUMMARY OF THE INVENTION

In general, the inventive quality control work station includes a support frame having a pair of side members, each of the side members having an upwardly extending rear support member. A work panel is supported by the frame and has a first, generally horizontal surface terminating in a rear edge. A second surface extends forwardly and bends angularly downward from the first surface.

A display panel is attached to the rear support members at a position generally above the rear edge of the first surface. The display panel includes a generally planar display surface which may be oriented to be substantially normal to the line of vision of a user of the station. The display panel includes means for retaining a data collecting device. A plurality of wheels is disposed in a load supporting relationship to the support frame for permitting easy relocation of the work station.

More particularly, a highly preferred support frame will include side members, each of which is formed of a single piece of tubing joined by welding at the ends to form a unitary structure. A rear support member may be bolted or otherwise attached to each of the side members and extend generally upwardly for supporting the display panel. One of the rear support members is configured to receive an optional post for supporting a lamp while the other support member may receive an optional bracket having an extensible rod for displaying a blueprint. Since it is desirable for the line of vision of the user to be generally normal to the surface of the display panel, preferred rear support members will be bent slightly rearward.

A work panel is mounted on the support frame and has a first, generally horizontal surface which terminates in a rear edge. In a preferred embodiment, the generally horizontal surface will extend forward sufficiently far to provide an area upon which certain tools used in the quality control function may be placed. For example, this horizontal surface may be used to support a computer video display terminal, inspection tools or the like.

The work panel also includes a forward extending second surface which depends slightly angularly downward from the first surface to provide a convenient area which may be used for writing. A computer key terminal may also be supported on the second surface for easy access.

In a highly preferred embodiment, the angled surface of the work panel will terminate at its forward edge in a tray for receiving and retaining writing instruments, small tools and the like. The tray preferably includes a front wall which projects upward and terminates at an edge which lies slightly above the projected plane of the angled surface. When constructed in this way, the wall will prevent objects such as expensive computer key terminals from sliding off the angled surface to the floor below.

A display panel is attached to the rear support members at a position generally above the rear edge of the work panel. It has a generally planar display surface and is preferably mounted in cooperation with the rear support members to be movable to any one of several positions of varying height. This adjustment feature, coupled with the slight rearward angularity of the rear support members, permits positioning the display panel so that it is substantially normal to the line of vision for most users of the station.

The inventive quality control work station will often be used in a technologically sophisticated environment. Therefore, a highly preferred display panel will include means for retaining an electronic data collecting and display device so that the device is both visible and readily accessible to the station user. Preferably, this is accomplished by providing a channel along the lower edge of the display panel for retention and display of the device.

In a highly preferred embodiment of the work station of this invention, the display panel will also include a paper-retaining mechanism arranged along its upper edge. A preferred mechanism includes a horizontally arranged cavity with a friction bar movably confined within the cavity. The friction bar is urged by gravity to a position in contact with the display panel. A piece of paper may be inserted through a lower slot which opens into the cavity. When the paper is interposed between the bar and the panel and released, it will be frictionally retained in a displayed position.

A pair of rear wheels are mounted on the support frame in a load supporting relationship to permit easy movement of the quality control work station from place to place. Optionally, a lower compartment may be installed in the station for receiving and storing items related to the quality control function. An additional pair of wheels may be mounted on and beneath this compartment for permitting rolling movement of the station.

Other optional features which may be a part of the quality control work station include a removable post for supporting a lamp and a removable bracket having a rod extensible to the side of the work station for supporting blueprints thereon.

DETAILED DESCRIPTIONS OF PREFERRED EMBODIMENTS

Figure 2:
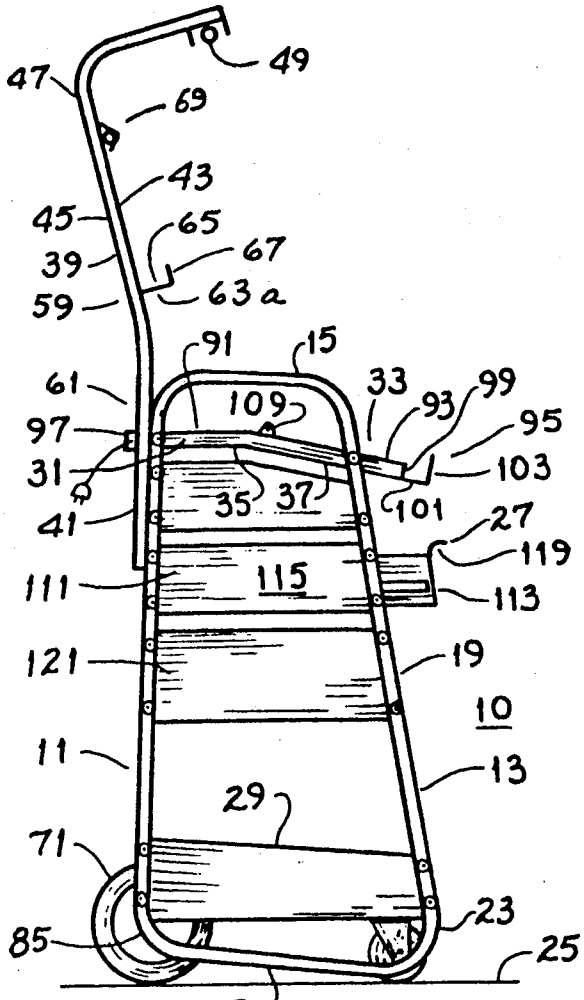
FIG. 2 is a side elevation view of the work station of FIG. 1.
Figure 1:
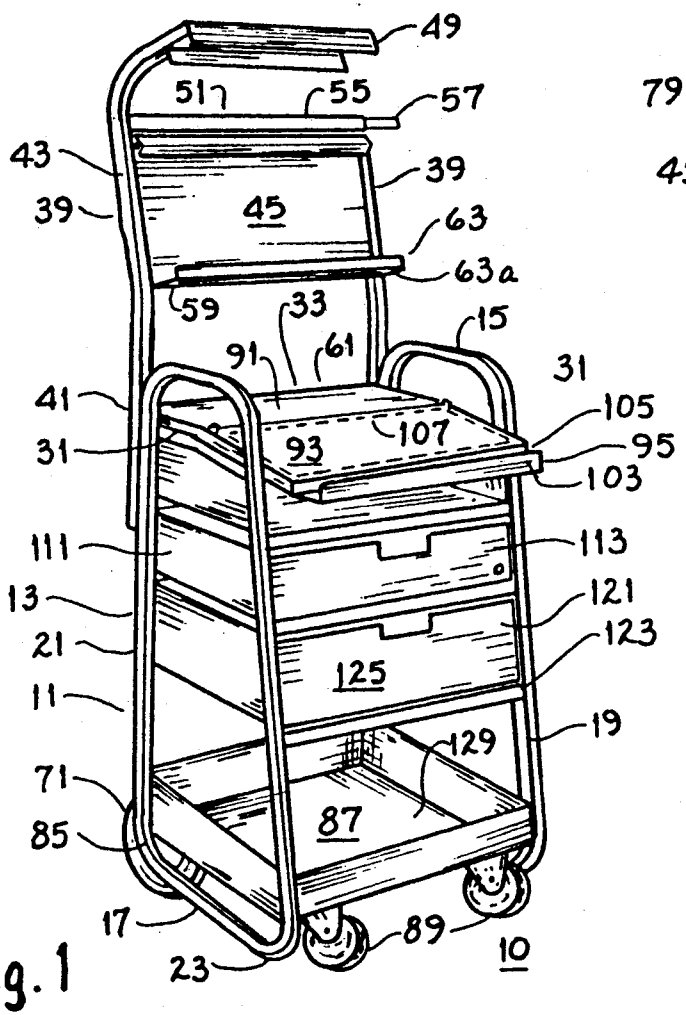
FIG. 1 is an elevation perspective view of the inventive quality control work station with part shown in dotted outline.

Referring first to FIGS. 1 and 2, quality control work station 10 is shown to include a support frame 11 having a pair of side members 13. In a highly preferred embodiment, each of side members 13 is made of a single piece of tubing having its ends welded together to form a unitary structure. While the tubing may have any convenient cross-sectional shape, the use of tubing which has a generally square cross-section with rounded corners will facilitate tube bending as well as the attachment of other work station components.

When so formed, each side member 13 will define an upper rail 15, a lower rail 17, a front rail 19 and a rear rail 21 with lower and upper rails 17, 15 being generally parallel to one another. Lower rail 17 and front rail 19 join to define a knee 23 for supporting the front portion of station 10 upon floor 25. The area circumscribed by a side member 13 is generally trapezoidal in shape and preferably left open to permit optional drawers 27 and compartments 29 to be quickly and easily mounted or removed.

Support frame 11 also includes a pair of opposed side brackets 31 for supporting a work panel 33. Brackets 31 may be made of tubing of the same type from which side members 13 are made and will preferably be attached to the inward side of the respective side member 13. When mounted in this way, brackets 31 will each present a horizontal face projecting inwardly for supporting work panel 33 in a manner described hereafter. Side brackets 31 will be slightly bent at their central regions to provide a horizontal portion 35 and an angularly disposed portion 37.

Attached to each of side members 13 is an upwardly extending rear support member 39 which may be formed of tubing similar to that used to make side members 13. Attachment is preferably by removable bolts or fasteners. Each rear support member 39 includes a mounting portion 41 formed to be in surface contact with its associated side member 13 for providing secure mounting. The arm 43 of each support member 39 extends upwardly and slightly rearwardly so that a display panel 45 mounted thereon will have its front surface more nearly normal to the line of vision of the user of station 10.

Figure 3:
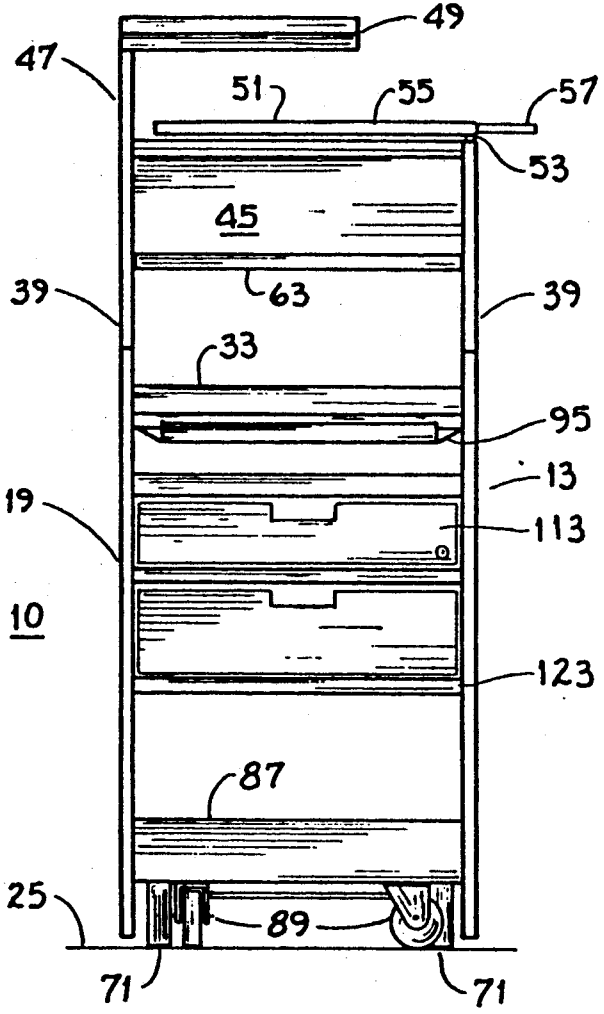
FIG. 3 is a front elevation view of the quality control work station of FIG. 1.

Referring particularly to FIGS. 2 and 3, quality control work station 10 may optionally include a post 47 for supporting a lamp 49. As best seen in FIG. 2, post 47 is bent forward in a plane generally parallel to that defined by side members 13 so that supported lamp 49 will illuminate display panel 45 and work panel 33 while yet avoiding the glare of light into the eyes of the user. The lower end of post 47 is sized to be slidably telescopically received in an open end of a rear support member 39 with slight clearance. If tubing with a generally square cross-section is used for the lower end of post 47, lamp 49 will be maintained in a position without annoying rotation. Quick attachment, removal and position retention of post 47 and lamp 49 may thereby be effected.

Referring to FIGS. 1 and 3, a highly preferred quality control work station 10 also has a generally L-shaped bracket 51 which may likewise be formed of tubing having a generally square cross-section. Bracket 51 has a first, downwardly extending leg 53 for attaching bracket 51 to a rear support member 39. Leg 53 is preferably sized to be slidably, telescopically received in an open end of a rear support member 39 with slight clearance. Bracket 51 also has a second, generally horizontal leg 55 for supporting a rod 57.

In a highly preferred embodiment, leg 55 is hollow and leg 55 and rod 57 have the same cross-sectional shape and are cooperatively sized with slight clearance so that rod 57 may be easily telescopically positioned within leg 55. While any convenient cross-sectional shape may be selected, a preferred rod 57 and leg 55 have a square or rectangular cross-sectional shape. This shape prevents rotation of rod 57 within leg 5 and also provides a flat surface upon which to mount documents for display.

When used, rod 57 is extended to the side of quality control work station 10. One end of rod 57 should remain telescopically engaged with leg 55 to the extent necessary to provide support for rod 57. A stop (not shown) may be provided for the purpose. Blueprints or other documents may be mounted on rod 57 for easy viewing by the user of station 10. Temporary mounting of the documents on rod 57 may be by clamps or, preferably, a plurality of small magnets or a magnetic strip. When not in use, rod 57 may be telescoped into leg 55 for storage.

Referring next to FIGS. 1, 2 and 3, a display panel 45 is attached to rear support members 39 and has its lower edge 59 positioned generally above and in a spaced relationship to rear edge 61 of work panel 33. Display panel 45 is preferably made of ABS plastic, is generally rectangular in frontal shape and includes a planar display surface. In a highly preferred embodiment, rear support members 39 and side members 13 will be cooperatively configured with plural mounting holes to permit locating display panel 45 at any one of two or more heights above floor 25. This feature will permit display panel 45 to be aligned to be more nearly normal to the line of vision. Better accommodation of the individual height of the user will result.

Along its lower edge, display panel 45 includes means 63 such as a channel 63a for retaining a data collecting device (not shown). A convenient data collecting device is made by DataMyte Corporation of Minnetonka, Minnesota. Such a device can transmit and receive computerized data, can be programmed by a computer and is able to receive, store and graph data taken electronically from digital and analog gauges used at quality control work station 10.

A highly preferred embodiment of channel 63a will include a lip 65 extending forwardly from the display panel and a retaining edge 67 extending upwardly from lip 65. The spacing between edge 67 and panel 45 is preferably selected to be only slightly greater than the thickness of the base of the data collecting device. An opening (not shown) may be formed at the intersection of panel 45 and lip 65 to accommodate an electrical cord for powering the data collecting device, if needed. When constructed in that way, display panel 45 and its associated channel 63a will support the data collecting device for easy visibility and quick access by hand. It will also help prevent the device from tipping forward, falling and being damaged.

Figure 5:
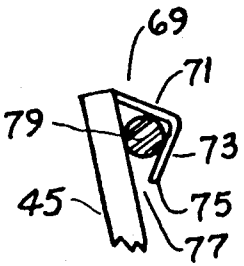
FIG. 5 is an enlarged side elevation view of the paper-retaining mechanism shown in FIG. 2.

Referring next to FIGS. 2 and 5, a highly preferred display panel 45 will also include paper-retaining means 69 disposed at the top for releasably retaining a sheet of paper. In a highly preferred embodiment, paper-retaining means 69 will include a top plate 71 which extends outward away from panel 45 and slightly angularly downward. A front plate 73 extends downwardly and slightly rearwardly from top plate 71 and terminates at an edge 75 which is slightly spaced from panel 45. Display panel 45, top plate 71 and front plate 73 thereby cooperate to define an elongate, generally triangular shaped, horizontally disposed cavity having a lower slot 77 opening into the cavity. An elongate friction bar 79 made of plastic or slightly resilient rubber is movably confined in the cavity and has a diameter selected so that when bar 79 is urged upward toward top plate 71, a slight space appears between bar 79 and display panel 45.

From the foregoing, it will be appreciated that gravity will urge bar 79 downward to be confined between and in contact with display panel 45 and front plate 73. A sheet of paper or other flat, thin material may be inserted upward through slot 77 to a location between bar 79 and display panel 45. Gravity acting upon bar 79 will cause the paper to be retained in a position for viewing on display panel 45. When the user wishes to remove the paper, it may simply be drawn downward to a point of release. It is also to be appreciated that construction of paper-retaining means 69 in the described manner will permit insertion or withdrawal of a sheet of paper using one hand.

Referring to FIGS. 1–4 a pair of wheels 81 are rotatably mounted on an axle 83 which is attached to side members 13 at rear lower knee 85. As best seen in FIG. 2 and in a highly preferred embodiment, wheels 81 will be mounted to protrude only slightly below the lower surface of lower rail 17. When wheels 81 are so mounted, there will be only a slight clearance between the lower rear knees 85 of side members 13 and floor 25 below. If quality control work station 10 is used without an optional tool tray 87 and its associated casters 89 (as described in detail following), lower front knee 23 will rest upon floor 25 and will assist in preventing inadvertent movement of station 10 while it is in use.

Referring next to FIGS. 1–3, the quality control work station also includes a work panel 33 which is supported by brackets 31. Panel 33 has a first, generally horizontal surface 91 terminating in a rear edge 61. A second surface 93 depends angularly slightly downward and forward from first surface 91 and terminates in a tray 95. Horizontal first surface 91 forms a convenient platform for placement of a video display terminal, hand held measuring instruments or the like. Angled second surface 93 is conveniently sloped for writing or for the use of a computer key terminal which may be placed thereon. For added utility, an electrical outlet strip 97 may be mounted at the rear of quality control work station 10 adjacent rear edge 61 of work panel 33.

A highly preferred tray 95 will be sized for receiving small tools, writing instruments and the like and will include a rear wall 99, a bottom 101 and a front wall 103 which may be formed as shown or formed to an arcuate shape. However, a preferred front wall 103 will project upward and terminate at an edge 105 which is above an imaginary line resulting from projecting second surface 93 to front wall 103. When constructed in that way, front wall 103 will prevent objects from sliding from second surface 93 to floor 25 below.

Work panel 33 may be formed of sheet metal or, preferably, of a single piece of ABS plastic. It will be apparent from the foregoing that the angular configuration of side brackets 31 and work panel 33 should be cooperatively selected so that brackets 31 support work panel 33 substantially along the entirety of both panel edges. As best seen FIG. 2, work panel 33 and brackets 31 are selected to have a front-to-rear length such that the portion of panel 33 which extends forward of side member 13 is located substantially vertically above or rearward of lower front knee 23. When so arranged, the imposition of tipping forces upon quality control work station 10 will be avoided when downward pressure is placed upon angled surface 93 for any reason.

Optionally, the work panel may also include a clear plastic shield 107 (shown in dotted outline) which has a size and shape selected to substantially cover second surface 93. Shield 107 may be connected to brackets 31 or to work panel 33 at hinge points 109 and will serve to protect papers placed between panel 33 and shield 107 while yet permitting easy insertion, viewing and withdrawal of the papers.

Depending upon the needs of the particular quality control work station user, its utility will be enhanced by several optional features. Referring to FIGS. 1–3, work station 10 may also include a shelf 111 for slidably receiving a drawer 113. A preferred shelf 111 will be formed of a single piece of ABS plastic and will have vertical sides 115 for attachment to side members 13. A downwardly extending front lip 117 on shelf 111 permits easy insertion and withdrawal of drawer 113. A preferred drawer 113 will have an outward, downward scrolled lip 119 for easy fingertip grasping.

Figure 4:
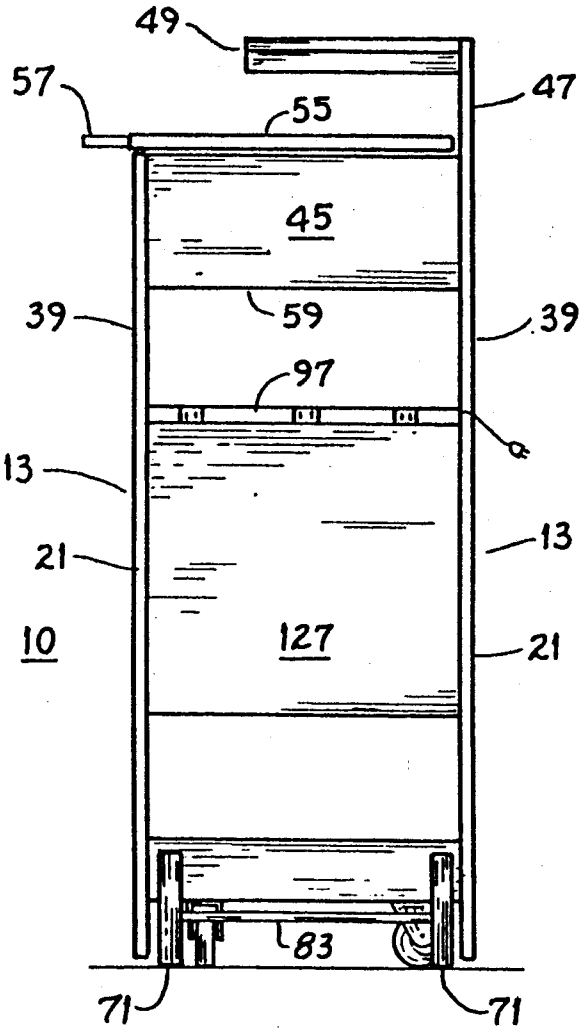
FIG. 4 is a rear elevation view of the work station of FIG. 1.

Yet another optional feature includes a computer printer compartment 121 which uses a shelf 111 slightly deeper than but otherwise closely similar to the shelf 111 described above. For easy access to and use of the printer, a pull out tray 125 and a paper basket may be disposed on the shelf. Referring also to FIG. 4 rigidity of the quality control work station will be enhanced and the rearward travel of drawer 113 and tray 125 will be limited by the inclusion of a back panel 127 which is attached to rear rails 21 of side members 13 at several points.

Still another optional feature is a tool and gauge tray 87 formed as a pan-like structure to be bolted or otherwise attached at its four corners to side members 13. An interior cavity 129 will restrain the tools and gauges while quality control work station 10 is being relocated but will also permit easy access to them when station 10 is in use. In a highly preferred embodiment, this tray 87 will include a pair of casters 89 mounted adjacent the front edge of tray 87 for supporting work station 10 and permitting its movement, in an upright attitude, to a new location. Casters 89 may be lockable to prevent inadvertent movement of station 10 when it is in use.

While the principles of this invention have been described in connection with specific embodiments, it should be understood clearly that these descriptions are made only by way of example and are not intended to limit the scope of the invention.

I claim:

1. A work station especially useful for quality control purposes including:

a support frame including a pair of side members, each of the side members having an upwardly extending rear support member, and lower and front rails cooperating to define a knee for providing a means of support for the station;

a work panel supported by the frame, the panel having a first, generally horizontal rear surface terminating in a rear edge and a forwardly extending second surface depending angularly downward from the first surface and located above said knee in a position to substantially avoid the imposition of tipping forces on the work station when downward pressure is applied to the second surface;

a display panel attached to the rear support members at a position generally above the rear edge, the display panel including a generally planar display surface and means for retaining a data collecting device, said retaining means having a generally planar lip extending forwardly from a lower edge of the display surface and a generally planar retaining edge extending upwardly from the lip to define a channel for retention of a data collecting device in position to be readily viewed and accessed by a user of the work station; and a plurality of wheels disposed in a load supporting relationship to the support frame for relocating the work station.

2. The quality control work station of claim 1 wherein the second surface includes a front terminus forming a tray for receiving and retaining writing instruments, tools and the like, the tray including a front wall projecting upwardly and terminating at an edge which lies above a line defined by projecting the second surface to intersect the front wall, whereby the wall and the edge prevent objects from sliding downwardly off the second surface.

3. The quality control work station of claim 2 wherein the display panel further includes paper-retaining means disposed at the top of the display surface for releasably retaining a sheet of paper, the paper-retaining means having a bar movably confined within a space and urged by gravity to a position for frictionally engaging and retaining a sheet of paper inserted between the bar and the display panel.

4. The quality control work station of claim 1 further including a post for supporting a lamp in position to illuminate the display surface, the post being removably attachable to a rear support member.

5. A quality control work station including:

a support frame including a pair of side members, each of the side members being formed of a single piece of rigid tubing and having an upwardly extending rear support member attached thereto;

a work panel supported by the frame and having a first surface and a second surface defining an obtuse angle therebetween;

a display panel attached to the rear support members and positionally movable with respect to the work panel, the display panel including a generally planar display surface and a lower channel for retention of a data collecting device;

means disposed at the top of the display panel for releasably retaining a sheet of paper, the paper-retaining means including a cavity, a friction bar movably confined within the cavity, and a lower slot opening into the cavity for permitting insertion of a piece of paper such that the paper may be frictionally retained between the display surface and the bar;

a generally L-shaped bracket having a first leg extending downwardly to attach the bracket to one of the rear support members and a generally horizontal second leg;

a horizontally-disposed rod supported by the second leg for relative horizontal movement with respect thereto;

a receptacle removably mounted on the support frame for housing apparatus used for quality control purposes; and a plurality of wheels mounted on the frame to facilitate relocation of the work station.

6. The quality control work station of claim 5 wherein the rod is supported by being telescopically received in the second leg.

7. The quality control work station of claim 6 further including a plurality of wheels mounted on the receptacle to facilitate relocation of the work station.

8. The quality control work station of claim 7 further including a post for supporting a lamp in a position to illuminate the display surface, the post being removably attachable to a rear support member.

9. The quality control work station of claim 5 wherein the second surface includes a front terminus forming a try for receiving and retaining writing instruments, tools and the like, the tray including a front wall projecting upwardly and terminating at an edge which lies above a line defined by projecting the second surface to intersect the front wall, whereby the wall and the edge prevent objects from sliding downwardly off the second surface.

10. A work station especially useful for quality control purposes including:

a support frame including a pair of side members, each of the side members a single piece of tubing formed to define a generally trapezoidal shape with arcuate corners and circumscribing an open area;

an upwardly extending rear support member removably attached to each side member;

a work panel on the frame with a generally horizontal first surface terminating in a rear edge and a forwardly extending second surface depending angularly downwardly from the first surface;

a display panel attached to the rear support members at position generally above and spaced from the rear edge, the display panel having a generally planar display surface adjustably movable with respect to the work panel to be normal to the line of vision of a user of the station, the position of the display panel being adjustable by changing the location of attachment between the rear support members and the side members; and a plurality of wheels disposed in a load-supporting relationship to the support frame for facilitating the relocation of the work station.

11. The quality control work station of claim 10 wherein the display panel includes a channel disposed along the lower edge thereof for receiving and displaying a data collecting device, the channel including a generally planar lip extending forwardly from the display panel and a generally planar retaining edge extending upwardly from the lip.

12. The quality control work station of claim 11 further including a paper-retaining means located at the top of the display panel and including a generally horizontally disposed cavity, a friction bar movably confined within the cavity and urged by gravity to a position of contact with the display panel, and a slot opening into the cavity for insertion of a piece of paper, the paper being frictionally retained between the display panel and the bar.

13. The quality control work station of claim 12 further including a bracket having a first, downwardly extending leg for attaching the bracket to the work station and a second, generally horizontal leg for telescopically receiving a rod, the rod being extensible to a side of the work station for supporting engineering drawings in an attitude to be visible by a user of the station.

14. The quality control work station of claim 13 further including a post for supporting a lamp in position to illuminate the display panel, the post removably attachable to a rear support member, and a clear cover mounted to be positionally movable for overlying and protecting documents placed on the second surface.

15. A work station especially useful for quality control purposes including:

a support frame including a pair of side members, each of the side members having an upwardly extending rear support member, and lower and front rails cooperating to define a knee for providing a means of support for the station;

a work panel supported by the frame, the panel having a first, generally horizontal rear surface terminating in a rear edge and a forwardly extending second surface depending angularly downward from the first surface and located above said knee in a position to substantially avoid the imposition of tipping forces on the work station when downward pressure is applied to the second surface;

a display panel attached to the rear support members at a position generally above the rear edge, the display panel including a generally planar display surface and means for retaining a data collecting device adjacent to the display surface; and a plurality of wheels disposed in a load supporting relationship to the support frame for relocating the work station.

* * * * *

UNITED STATES PATENT AND TRADEMARK OFFICE

CERTIFICATE OF CORRECTION

PATENT NO. : 5,013,103

DATED : May 7, 1991

INVENTOR(S) : Thomas E. Addison

It is certified that error appears in the above-identified patent and that said Letters Patent is hereby corrected as shown below:

In column 1, line 46, "so" should be --some--.

In column 6, line 1, "leg 5" should be --leg 55--.

Col. 9:
In claim 3, line 8, "panel" should be --surface--.

Col. 10:
In claim 14, line 5, "overlying" should be --overlaying--.

Signed and Sealed this

Twenty-second Day of September, 1992

*Attest:*

DOUGLAS B. COMER

*Attesting Officer*

*Acting Commissioner of Patents and Trademarks*